US007059808B2

(12) United States Patent
Risi

(10) Patent No.: US 7,059,808 B2
(45) Date of Patent: Jun. 13, 2006

(54) SPLIT KEY SEGMENTAL RETAINING WALL SYSTEM

(75) Inventor: Angelo Risi, Richmond Hill (CA)

(73) Assignee: Jagna Ltd., Thornhill (CA)

( * ) Notice: Subject to any disclaimer, the term of this patent is extended or adjusted under 35 U.S.C. 154(b) by 0 days.

(21) Appl. No.: 10/855,491

(22) Filed: May 28, 2004

(65) Prior Publication Data

US 2005/0274085 A1 Dec. 15, 2005

(51) Int. Cl.
*E02D 17/20* (2006.01)
*E04C 1/00* (2006.01)

(52) U.S. Cl. ..... 405/284; 405/286; 52/604; 52/605

(58) Field of Classification Search ..... 405/262, 405/272, 284, 286; 52/169.1, 169.2, 169.4, 52/596, 604, 605
See application file for complete search history.

(56) References Cited

U.S. PATENT DOCUMENTS

| | | | | |
|---|---|---|---|---|
| 2,462,289 | A * | 2/1949 | Rochow | 52/232 |
| 4,340,360 | A * | 7/1982 | Hoedl et al. | 432/119 |
| 4,490,075 | A | 12/1984 | Risi et al. | 405/273 |
| 4,815,897 | A | 3/1989 | Risi et al. | 405/284 |
| 4,860,505 | A * | 8/1989 | Bender | 405/286 |
| 5,031,376 | A | 7/1991 | Bender et al. | 52/609 |
| 5,064,313 | A | 11/1991 | Risi et al. | 405/284 |
| 5,248,226 | A | 9/1993 | Risi et al. | 405/284 |
| 5,417,523 | A * | 5/1995 | Scales | 405/284 |
| 5,653,558 | A | 8/1997 | Price | 405/284 |
| D403,437 | S | 12/1998 | Risi et al. | D25/113 |
| 6,178,715 | B1 * | 1/2001 | Pacitto et al. | 52/604 |
| 6,565,289 | B1 * | 5/2003 | Khamis | 405/286 |

FOREIGN PATENT DOCUMENTS

| | | |
|---|---|---|
| CA | 941626 | 2/1974 |
| CA | 51160 | 4/1983 |
| CA | 51313 | 5/1983 |
| CA | 57926 | 1/1987 |
| CA | 58080 | 2/1987 |
| CA | 58391 | 3/1987 |
| CA | 64161 | 9/1989 |

* cited by examiner

*Primary Examiner*—Meredith Petravick
*Assistant Examiner*—Tara L. Mayo
(74) *Attorney, Agent, or Firm*—Collard & Roe, P.C.

(57) ABSTRACT

A segmental earth retaining wall block having a front side, a top side with a transversal tongue of a given width projecting from it, the tongue extending at a first distance from the front side, and a bottom side with a transversal groove made in it, the groove being sized to receive the tongue of another similar block positioned below and thus to allow stacking of the blocks. The groove extends at a second distance from the front side that is smaller than the first distance, and the first and second distances are selected so that the tongue and the groove are offset with respect to each other over a distance that is smaller than the width of the tongue. The tongue is provided with a splitting groove sized and positioned to allow splitting of the tongue with a splitting tool along a transversal line that is positioned to permit the remaining portion of this tongue to fit into the groove of a further similar block stacked on top of the present block with the front side of this further similar block extending in a same vertical plane as the first side of the present block.

4 Claims, 9 Drawing Sheets

SPLIT KEY SEGMENTAL RETAINING WALL SYSTEM

FIELD OF THE INVENTION

The present invention relates to an improved segmental retaining wall system.

More particularly, the invention relates to a segmental retaining wall (SRW) system wherein each stackable block (also called "units", "SRW units" or "SRW blocks" hereinafter) is provided with a tongue with a splitting groove that allows the user to construct either a battered (inclined) or vertically aligned segmental retaining wall with the same unit.

BRIEF DESCRIPTION OF THE PRIOR ART

Segmental earth retaining walls are a category of earth retention system that utilize modular, dry stacked (no mortar), preliminary-cast concrete blocks to create a stable mass with sufficient weight to resist earth pressures developed by the adjacent soil.

In this field, it is of common practice to use segmental modular earth retaining wall blocks with a groove on their bottom side and a tongue on their upper side which are offset with respect to each other to allow "automatic" vertical and horizontal alignments of these blocks when they are assembled so as to form a uniformly inclined wall. In this connection, reference can be made to U.S. Pat. No. 4,490,075 granted on Dec. 25, 1984 in the name of A. RISI et al. Reference can also be made to FIGS. 1*a* and 1*b* of the accompanying drawings, identified as "prior art" and to numerous other utility patents and design patents that have been obtained over the last decades by the inventor of record.

If SRW blocks with such an offset tongue and groove system to create a batter or setback to the wall are commonly used, it remains that in design situations, a vertical wall (vs. a setback wall) is more desirable, and therefore, the use of the SRW unit in its current configuration (battered only) is limited. The following two examples are illustrative of these situations.

a) Sidewalls to Stairs

A stairway cut into an existing bank often requires retaining walls on either side to support the earth cut. If battered retaining walls are constructed on either side of the steps, the distance between the two walls increases as the steps ascend (see FIG. 12). This is due to the fact that with each step up, the wall offsets further back. As the two walls are facing each other, the total width of the stairs increases by an amount equal to twice the setback of the wall. With vertical sidewalls, the stair width is maintained throughout the entire flight (see FIG. 13).

b) Limited Space at Top of Wall

In some design situations, the space at the top of the wall is limited, either due to property lines, other structures, or simply a desire to maximize the usable land above the wall. With a battered structure, the wall requires greater horizontal distance at the top.

With the existing SRW blocks, due to the predetermined offset (X) between the tongue and groove (see FIGS. 1*a* and 1*b*), the batter or setback of the wall is always "automatically" achieved, resulting in a wall that may be engineered and constructed with a known vertical alignment. The degree of batter or setback in a wall is a critical element in the design with respect to the analysis and engineering performance of the wall, geometric alignment, and aesthetic look. The batter of the wall is calculated, in degrees, as the inverse $\mathrm{Tan}^{-1}$ (X/Y). A problem with this kind of SRW system is that depending on the kind of wall to be erected and the kind of inclination to be given to it, the modular, segmental retaining wall blocks may substantially vary in shape and size. The molds for such blocks are precision manufactured from high strength steel and are designed to withstand high stresses during the manufacturing process. As such, each mold is relatively expensive and may only last for a specific length of time or number of manufacturing cycles. In order to limit the costs associates with manufacturing a particular SRW system, the intention is therefore to keep the number of components and therefore molds, to a minimum. With each additional mold there are costs associates with not only the direct purchase of the mould, but also, the manufacturing time lost when chancing moulds, the increased complexity of managing additional components, and the increased complexity of the system in general from a user perspective (education, inventory, etc.).

SUMMARY OF THE INVENTION

It has now been found that the above mentioned problem related to a need for diversity in the construction of a segmented earth retaining wall can easily be solved by using SRW blocks each having a split key tongue, viz. a tongue provided with a splitting groove that allows splitting of the tongue to make it smaller in width, and thus to adjust at will the position of the SRW blocks and thus the shape of the wall to be erected.

In other words, the split key tongue of each SRW block allows the user to construct vertical and battered walls with the same blocks, thereby eliminating the need for additional blocks and the costs and complexity discussed above.

Thus, the present invention is directed to an improved segmental retaining wall (SRW) block for use to construct a segmental earth retaining wall. Like all the existing block, the improved block according to the invention has:

- a front side;
- a top side with a transversal tongue of a given width projecting from it, the tongue extending at a first distance from the front side; and
- a bottom side with a transversal groove made in it, the groove being sized to receive the tongue of another similar block positioned below and thus to allow stacking of the blocks, the groove extending at a second distance from the front side that is smaller than the first distance;
- the first and second distance being selected so that the tongue and groove are offset with respect to each other over a distance that is smaller than the width of the tongue.

In accordance with the invention, the improvement lies in that the tongue is provided with a splitting groove sized and positioned to allow splitting of the tongue with a splitting tool along a transversal line that is positioned to permit the remaining portion of the tongue to fit into the groove of a further similar block stacked on top of the present block with the front side of this further similar block extending in a same vertical plane as the first side of the present block.

As a result, one may stack the above mentioned blocks as such, the resulting wall being then battered, or one may stack the above mentioned blocks after having splitted their tongues, the resulting wall being then vertical.

In accordance with a first preferred embodiment of the invention, the splitting groove extends at an angle of preferably about 30° to guide the splitting tool at this angle so as to impart a horizontal impact force to the portion of the tongue to be splitted and thus facilitate such a splitting.

In accordance with another preferred embodiment of the invention, the splitting groove has a bottom provided with a weak point preferably in the form of a 90° corner. This weak point is located at the place where the splitting tool hits the bottom edge.

In accordance with a further preferred embodiment of the invention, the bottom of the splitting groove extends below the top side of the block, thereby allowing formation of a recess when the tongue is splitted.

The invention and its advantages will be better understood upon reading the following non-restrictive detailed description made with reference to the accompanying drains.

DETAILED DESCRIPTION OF THE INVENTION

Figure 2:
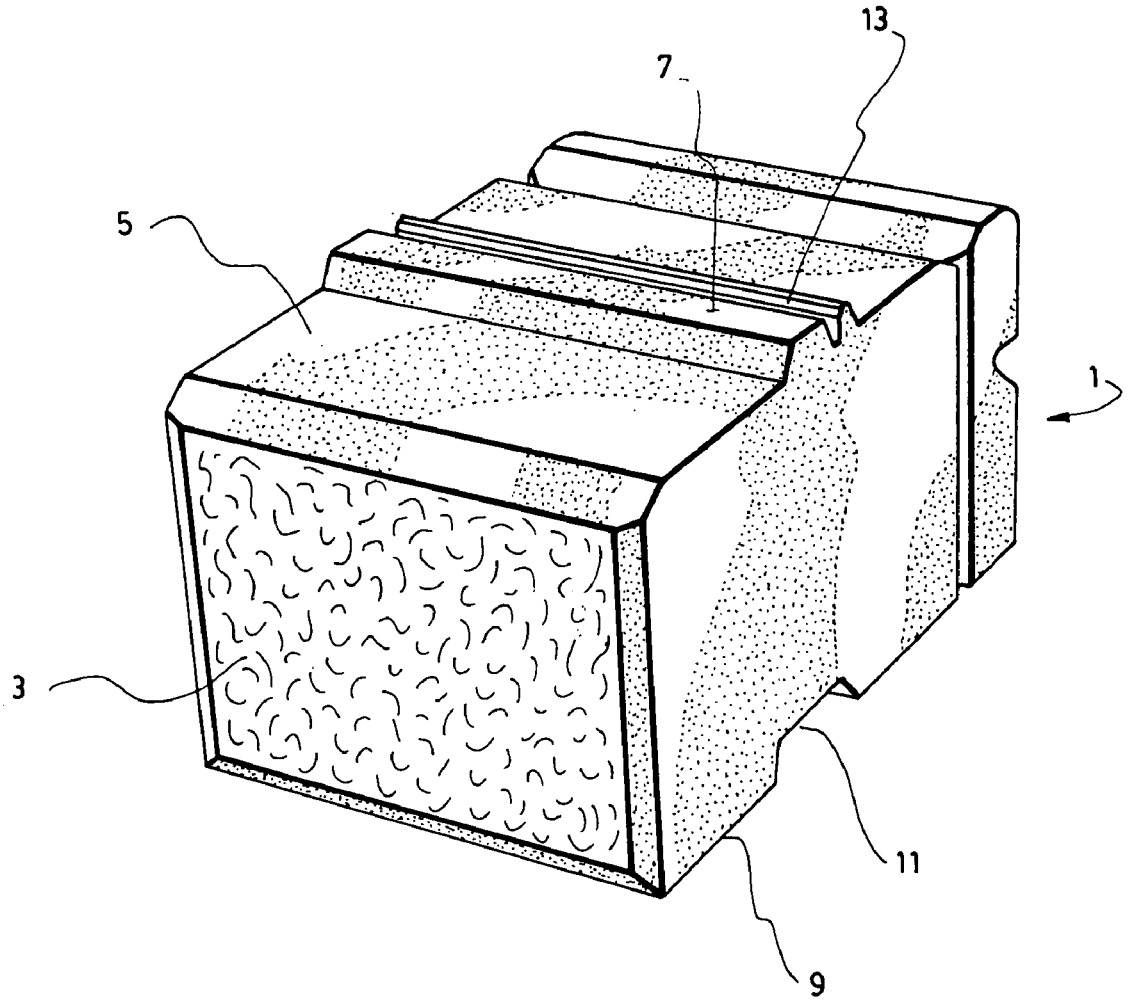
FIG. 2 is a front perspective view of a SRW block according to the invention.
Figure 3:
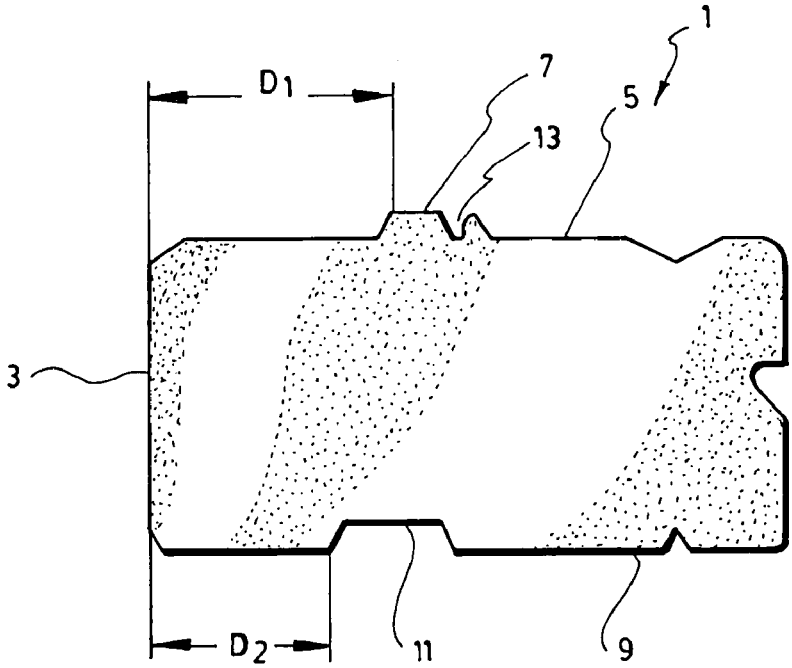
FIG. 3 is a side elevational view of the block shown in FIG. 3.
Figure 8:
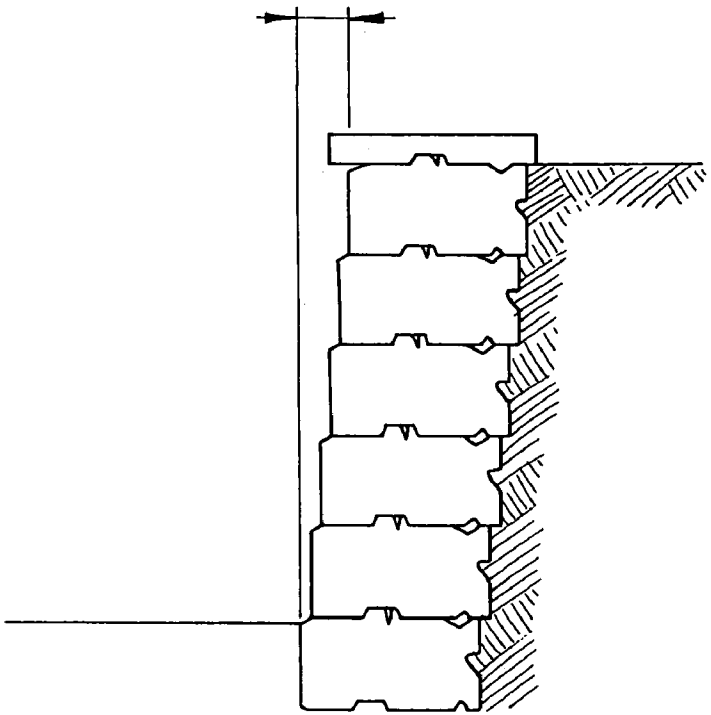
FIG. 8 is a side elevational view of a segmental retaining wall constructed with SRW blocks according to the invention, said wall being battered.
Figure 10:
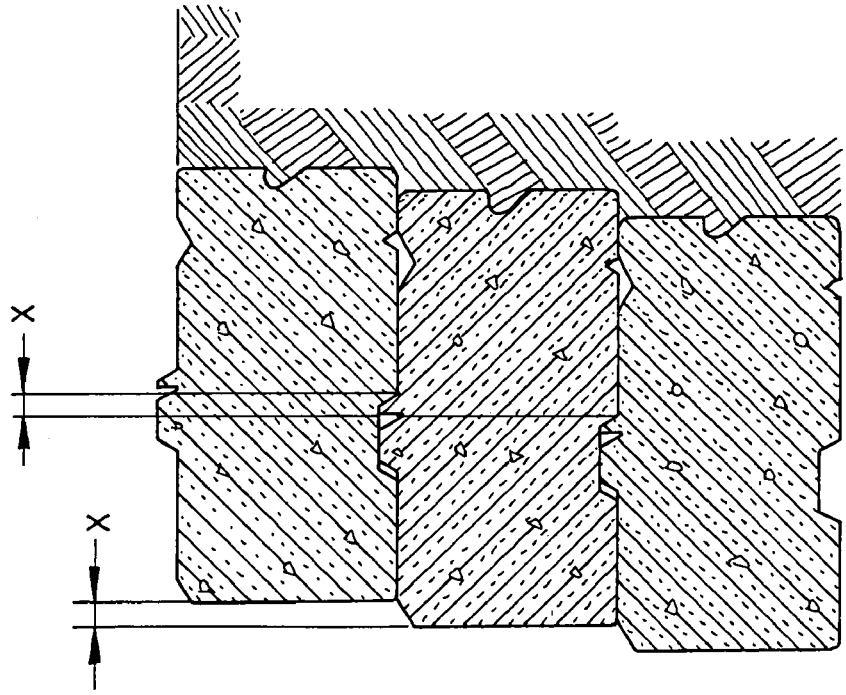
FIG. 10 is a side elevational view of three SRW units of the wall shown in FIG. 8.
Figure 12:
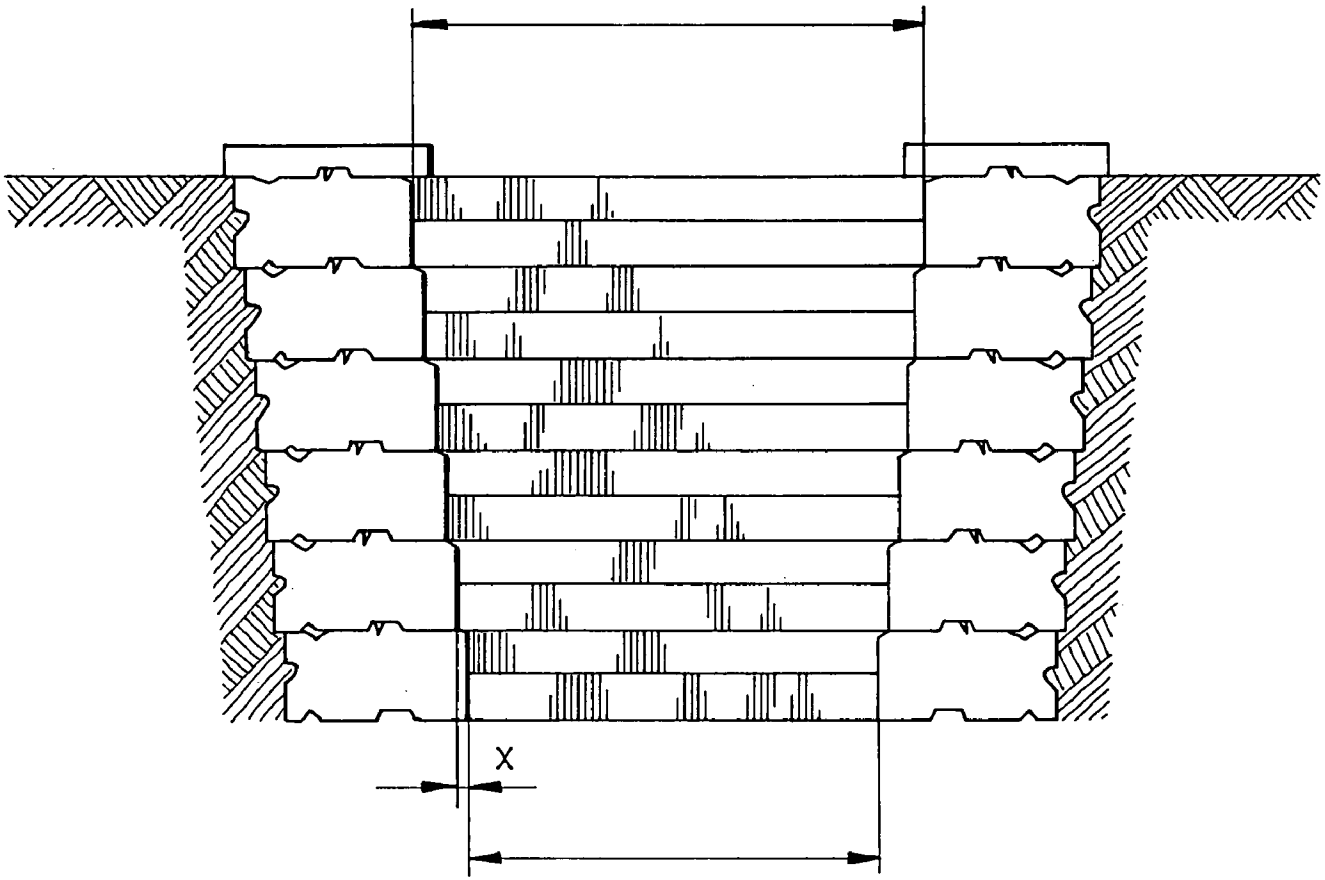
FIG. 12 is a side elevational view of a stair way cut with battered retaining walls constructed on both opposite sides with SRW blocks according to the invention.
Figure 13:
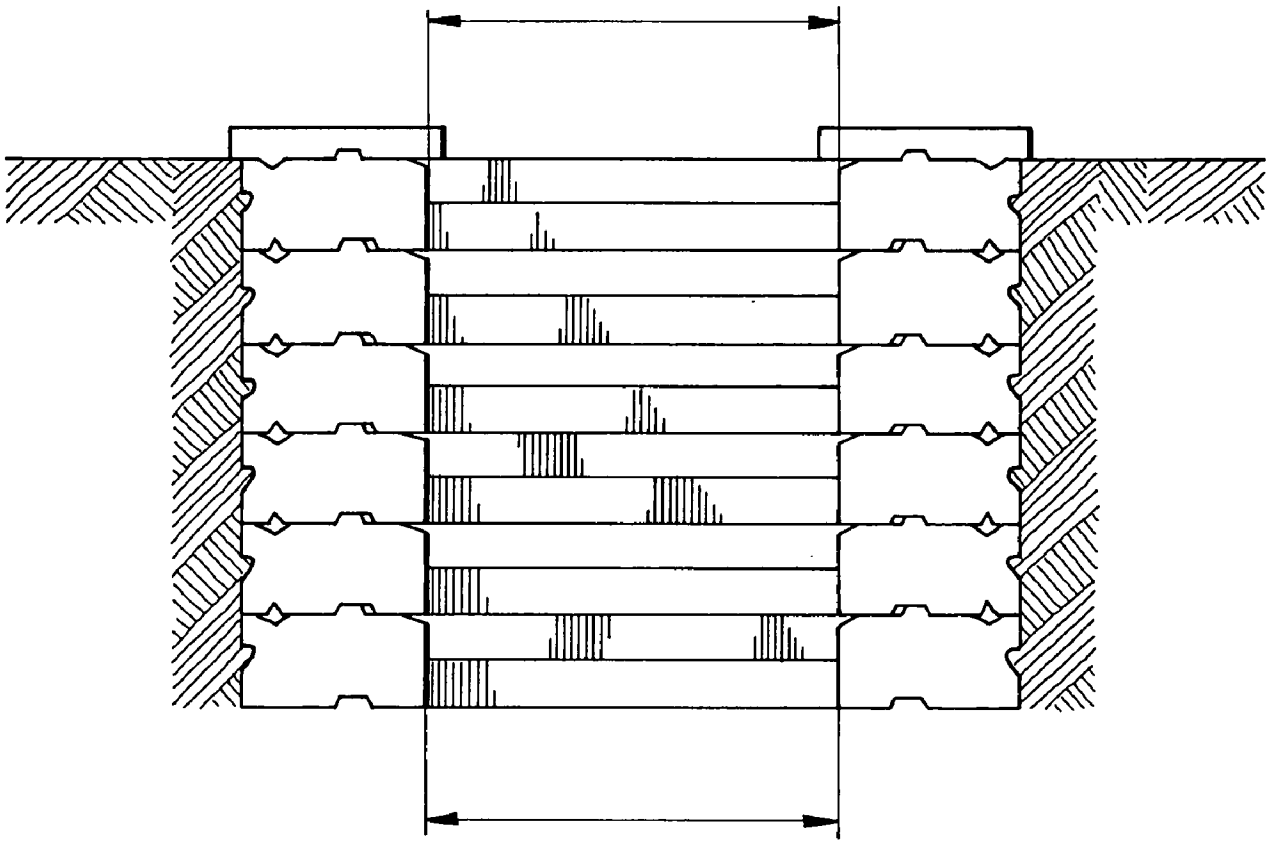
FIG. 13 is a side elevational view of a stair way cut with vertical retaining walls constructed on both opposite sides, said vertical walls being made from the same SRW blocks as those used to construct the walls shown in FIG. 12, after splitting of their tongues.

As clearly shown in FIGS. 2 and 3, the SRW block 1 according to the invention has:

- a front side 3;
- a top side 5 with a transversal tongue 7 of a given width projecting from it, the tongue 5 extending at a first distance D1 from the front side 3; and
- a bottom side 9 with a transversal groove 11 made in it, the groove being sized to receive the tongue 7 of another similar block positioned below and thus to allow stacking of the blocks (see FIGS. 8 and 10), the groove extending at a second distance D2 from the front side that is smaller than the first distance D1.

As also shown, the first and second distances D1 and D2 are selected so that the tongue 7 and the groove 11 are offset with respect to each other over a distance that is smaller than the width of the tongue 7.

Figure 9:
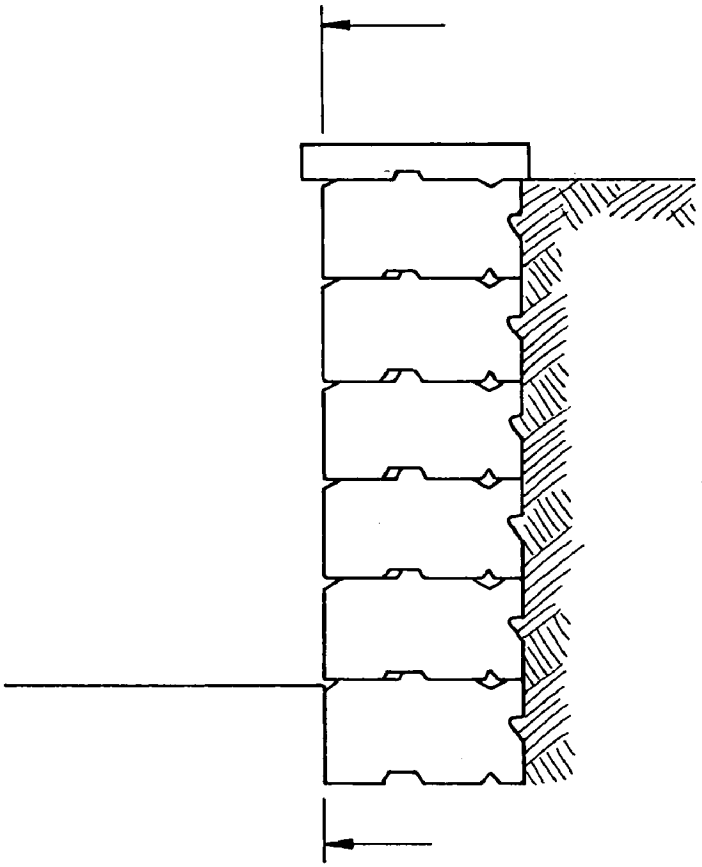
FIG. 9 is a side elevational view of a segmental retaining wall constructed with SRW blocks according to the invention, said wall being vertical.
Figure 11:
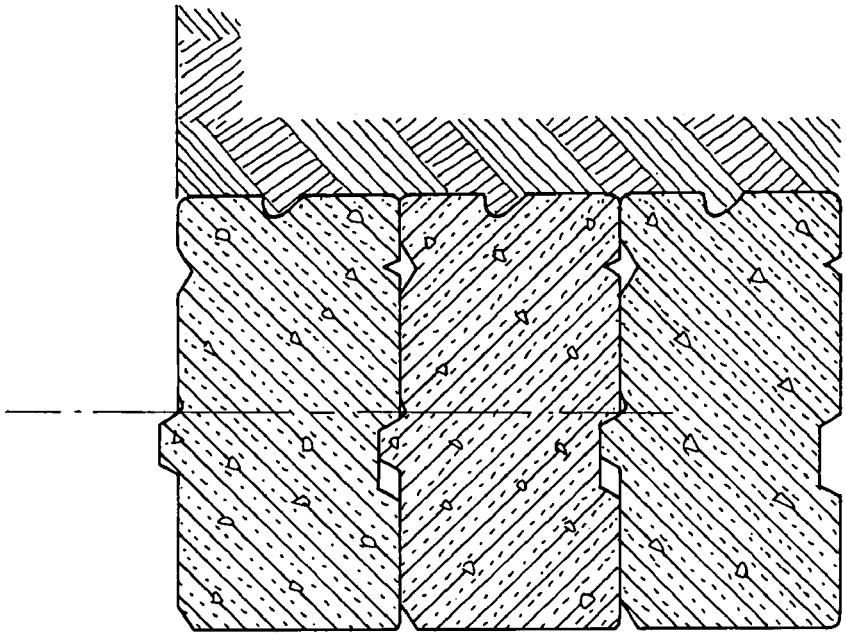
FIG. 11 is a side elevational view of three SRW units of the wall shown in FIG. 8.

In accordance with the invention, the tongue 7 is provided with a splitting groove 13 sized and positioned to allow splitting of the tongue 7 with a splitting tool along a transversal line that is positioned to permit the remaining portion of this tongue to fit into the groove of a further similar block stacked on top of the present block with the front side of this further similar block extending in a same vertical plane as the first side of the present block (see FIGS. 9 and 11).

Thus, the present invention essentially lies in the incorporation of the above mentioned splitting groove into a conventional SWR block provided with a tongue and groove system. The incorporation of such a splitting groove allows the units to be stacked in both battered and vertical alignments. Indeed, the splitting tongue within the tongue of the SRW block allows the user to easily and clearly remove a portion of the tongue, thereby allowing the blocks to be pushed forward to achieve a vertical alignment (see FIGS. 3 to 7*b*).

As aforesaid, the splitting grooves gives the user the ability to stack the wall at the predetermined setback (see FIGS. 8 and 10) or remove a portion of the tongue and stack the wall vertically (see FIGS. 9 and 11).

As many applications require both vertical and battered wall alignments, the present invention provides a means to increase the versatility of a SRW system and therefore expands the use of the blocks. In particular, when segmental retaining walls are used as sidewalls to a set of steps, the normal setback of the walls creates a widening effect in the stairway as it ascends. As this widening effect can interfere with the architectural alignment of the stairway and/or other structures, the use of vertical sidewalls is often necessary. Such may now be built up with the same blocks.

Figure 5:
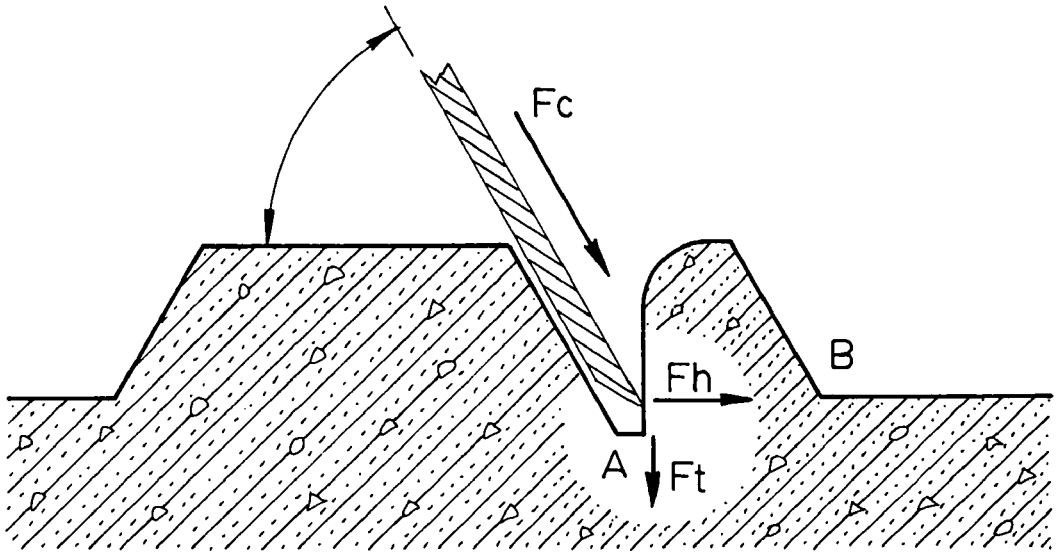
Figure 6:
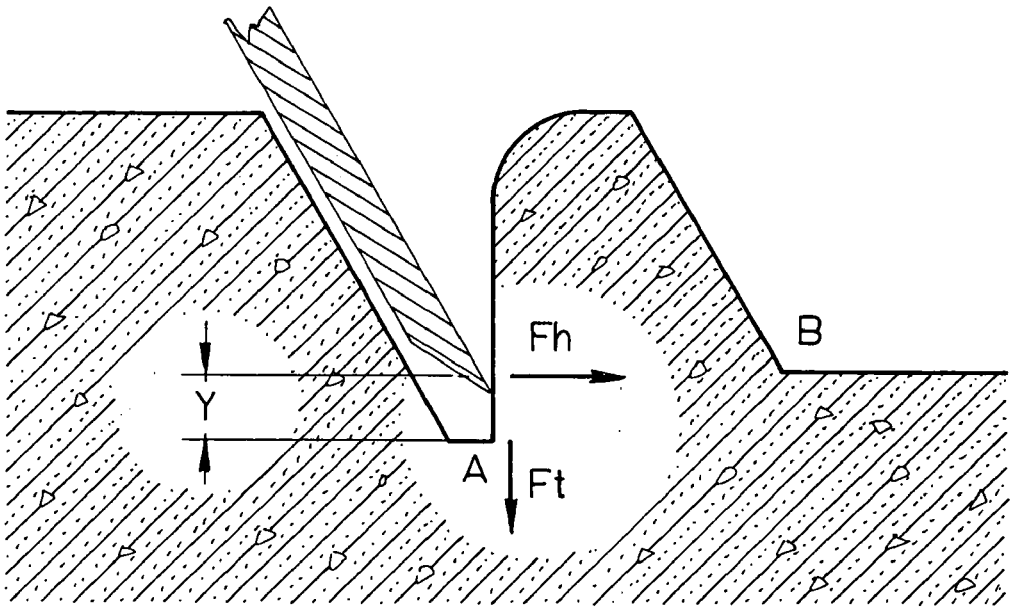

As better shown in FIGS. 5 and 6, the split key tongue of the SRW block according to the invention has a number of specific design elements which allow the user to stack the units in a vertical alignment easily, without compromising the structural integrity of the unit or the contact area between the blocks.

Figure 1B:
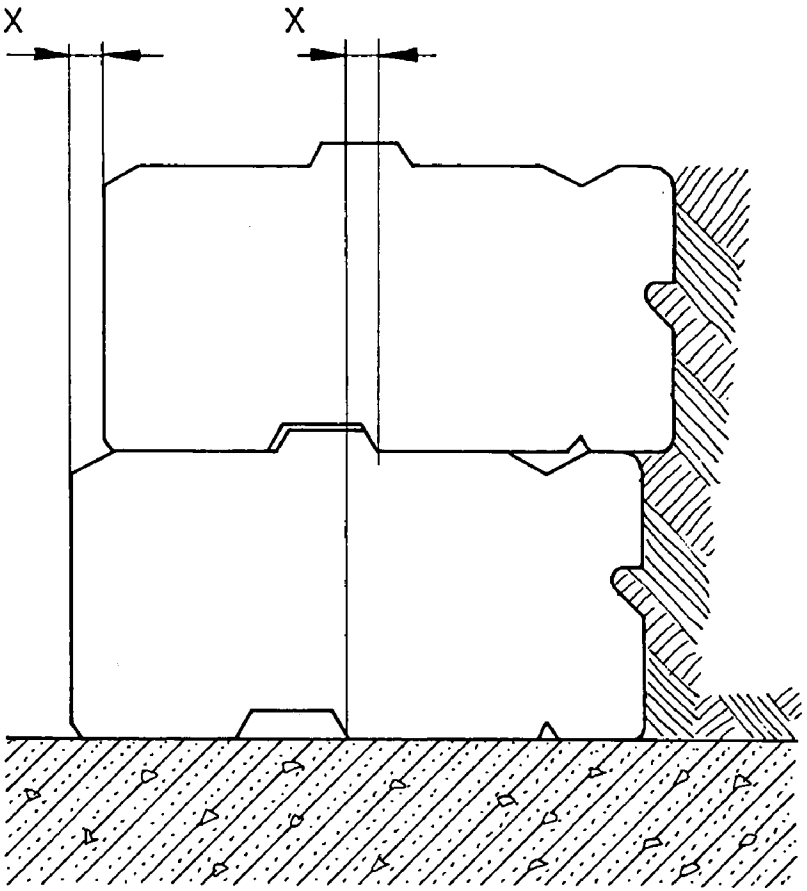
FIG. 1b ( PRIOR ART )
FIG. 1*b* identified as "prior art" is a larger view of two of the stacked blocks shown in FIG. 1.
Figure 1A:
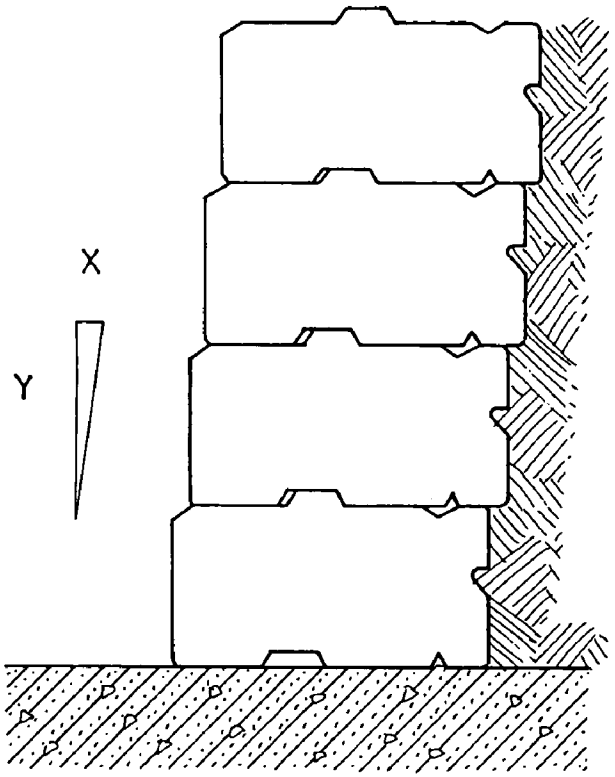
FIG. 1a ( PRIOR ART )
FIG. 1*a* identified as "prior art" is a side elevational view of a segmental retaining wall constructed with blocks of conventional structure (see U.S. design patent No. Des. 403,437 issued on Dec. 29, 1998)
Figure 4:
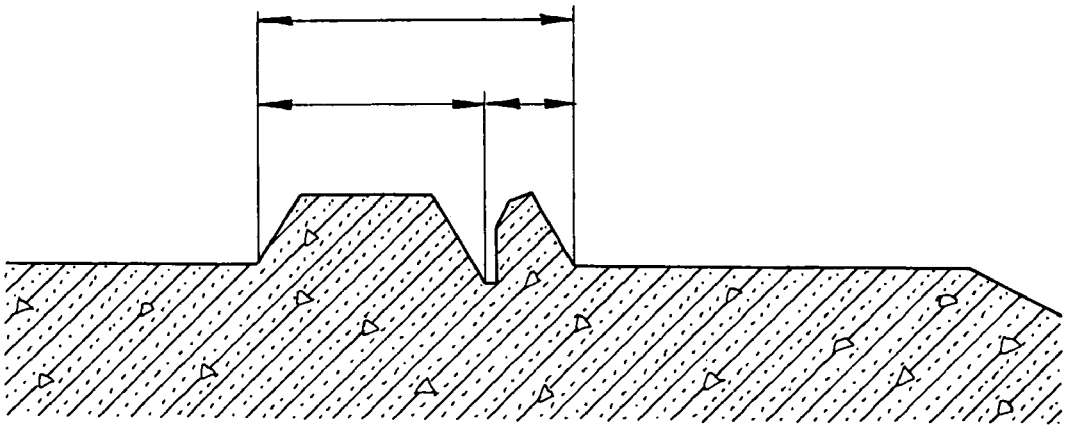
FIGS. 4, 5 and 6 are enlarged side elevational views of the split key tongue of the block shown in FIGS. 3*a* and 3*b*, showing in greater detail the sloped groove made in it and the way it can be splitted.

The first design element specific to the split key tongue lies in the dimensions of split-off portion of the tongue (see FIG. 4). In order to create a vertical alignment by removing the split-off portion, the width of the mass removed, including the existing groove, must equal the offset of the block. This width must actually be equal to the X dimension shown in FIGS. 1 and 1*b*.

A second of the design element specific to the split key tongue is that the splitting groove extends at an angle, viz. is sloped. Such a sloped splitting groove is designed to guide the splitting tool (usually a steel chisel) at an angle that is approximately 30 degrees below vertical. By delivering the impact force of the chisel (Fc) at this angle, a component of the force is imparted to the block as a horizontal force (Fh). It is this horizontal force that is required to create a tension crack between point A and point B, the path of least resistance through the key (see FIG. 5).

A third design element specific to the split key tongue lies in the presence of predetermined weak point A at a very specific location (see FIG. 6). The 90 degrees corner at point A is a natural weak point in the groove. As the horizontal force (Fh) is applied above this point, the concrete is forced into tension (Ft) in reaction to the clockwise moment generates. In order to oppose this moment (Fh×Y) the material reacts with a counter clockwise tension force. As concrete has little strength in tension, this force creates a tension crack from point A to point B. By establishing the weak point at A, the tension crack naturally propagates up from this point.

Figure 7B:
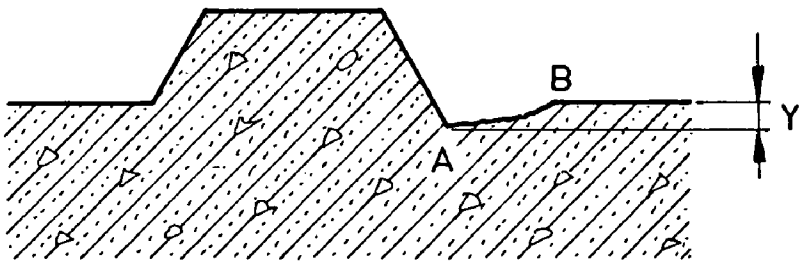
FIGS. 7*a* and 7*b* are side elevational views of the split key tongue of the block shown in FIGS. 3*a* and 3*b* before and after it has been splitted, respectively.
Figure 7A:
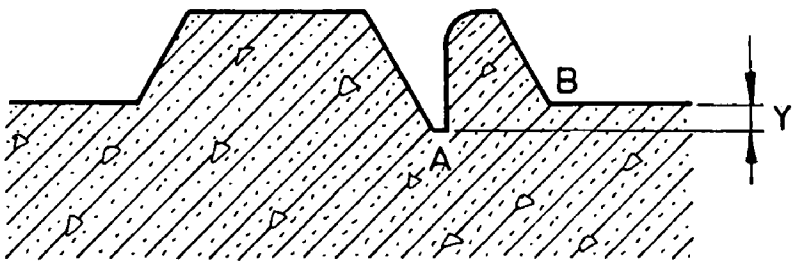

A fourth and last design element specific to the split key tongue lies in that the splitting groove is recessed (see FIGS. 7*a* and 7*b*). As the SRW units are stacked on top of one another, the contact surface between them must be perfectly level and free of debris. In order to ensure that the rough split created between point A and point B does not interfere with the contact area of the blocks, point A has been recessed. As a result, the splitting plane propagates upward toward the surface of the block. The split is limited to the surface of the block due to the fact that point B is another natural weak point. The resulting split is therefore kept below the top of the block and a clear contact area is maintained. Overall, the tension crack is controlled between the two predetermined entry (A) and exit (B) points, allowing the split off portion to be removed cleanly.

As discussed hereinabove in the Background of the invention, every additional component in a SRW system generates significant costs with respect to the initial mould purchase, changing moulds during manufacturing, inventory costs, and costs due to overall system complexity (education, contractor familiarity). The incorporation of the splitting groove according to the invention, advantageously allows the same block to be used in both battered and vertical applications. Thus, such incorporation increases the versatility of the system while limiting costs due to additional moulds, inventory, etc.

Of course, numerous modifications could be made to the preferred embodiment disclosed in detail hereinabove without departing from the scope of the invention. By way of example, in the illustrated embodiment, the tongue and groove extends over the full width of the SRW block. In practice, the tongue and even the groove could be shorter in width, the only requirement being that there is always a possibility to stack rows of blocks with the blocks of each row not necessarily vertically in line with the blocks of the adjacent rows.

The invention claimed is:

1. A segmental retaining wall (SRW) block for use to construct a segmental earth retaining wall, said block having:

(a) a front side;

(b) a top side with a single transversal tongue of a given width projecting from said top side, said tongue extending at a first distance from the front side; and (c) a bottom side with a single transversal groove made in said bottom side, said groove being sized to receive and matingly interlock with the tongue of another said block positioned below and thus to allow stacking of said blocks, said groove extending at a second distance from the front side, said second distance being smaller than the first distance, said first and second distance being selected so that said tongue and groove are offset with respect to each other over a distance that is smaller than the width of the tongue;

wherein said tongue is provided with a splitting groove, said splitting groove being sized and positioned to allow removal of a portion of the tongue with a splitting tool along a transversal line that is positioned to permit a remaining portion of said tongue to fit into the groove of a further said block stacked on top of the block with the front side of said further said block extending in a same vertical plane as the first side of the block;

wherein said splitting groove extends at an angle in order to guide the splitting tool at said angle so as to impart a horizontal impact force to the portion of the tongue to be removed and thus facilitate such a removal; and wherein the splitting groove has a bottom provided with a weak point at an edge where the splitting tool hits said bottom, said bottom extending below the top side of the block, thereby allowing formation of a recess when the portion of the tongue is removed;

whereby, in use, one may stack the above mentioned blocks as such, the resulting wall being then battered, or one may stack the above mentioned blocks after having removed portions of their tongues, the resulting wall being then vertical.

2. The SRW block of claim 1, wherein said splitting groove extends at an angle of about 30°.

3. The SRW block of claim 1, wherein the weak point is in the form of a 90° corner.

4. The SRW block of claim 1, wherein said block is of a given width and the tongue and the groove extend over all of said width.

* * * * *